US007198554B2

(12) United States Patent
Livingston

(10) Patent No.: US 7,198,554 B2
(45) Date of Patent: Apr. 3, 2007

(54) METHOD OF MAKING VALVE GUIDE HAVING TEXTURED EXTERNAL SURFACE

(75) Inventor: Howard M. Livingston, Long Grove, IL (US)

(73) Assignee: Helio Precision Products, Inc., Lake Bluff, IL (US)

( * ) Notice: Subject to any disclaimer, the term of this patent is extended or adjusted under 35 U.S.C. 154(b) by 121 days.

(21) Appl. No.: 10/819,878

(22) Filed: Apr. 7, 2004

(65) Prior Publication Data

US 2005/0227593 A1 Oct. 13, 2005

(51) Int. Cl.
*B24B 1/00* (2006.01)

(52) U.S. Cl. ..... 451/56; 451/444

(58) Field of Classification Search ..... 451/56, 451/51, 49, 179, 182, 444, 41; 125/11.01, 125/11.03

See application file for complete search history.

(56) References Cited

U.S. PATENT DOCUMENTS

| | | | | | |
|---|---|---|---|---|---|
| 1,339,452 | A | * | 5/1920 | Gorham | 125/11.03 |
| 2,305,115 | A | * | 12/1942 | Sneed | 125/11.06 |
| 2,677,362 | A | * | 5/1954 | Back | 125/37 |
| 2,801,499 | A | * | 8/1957 | Jones | 451/244 |
| 3,039,451 | A | * | 6/1962 | McConnell | 125/37 |
| 3,258,838 | A | | 7/1966 | Tilton, Jr. | |
| 3,384,515 | A | | 5/1968 | Ackerman et al. | |
| 3,828,415 | A | | 8/1974 | Kammeraad et al. | |
| 4,342,293 | A | | 8/1982 | Nickerson | |
| 4,896,638 | A | | 1/1990 | Shepley | |
| 5,070,653 | A | * | 12/1991 | Amundsen | 451/279 |
| 5,186,135 | A | * | 2/1993 | Kovach | 123/188.3 |
| 5,190,002 | A | | 3/1993 | Wietig | |
| 5,218,788 | A | * | 6/1993 | Ritt et al. | 451/242 |
| 5,319,916 | A | * | 6/1994 | Ritt et al. | 451/49 |
| 5,484,327 | A | * | 1/1996 | Kovach | 451/49 |
| 5,674,111 | A | * | 10/1997 | Harada et al. | 451/49 |

FOREIGN PATENT DOCUMENTS

| | | |
|---|---|---|
| JP | 58082672 | 5/1983 |
| WO | WO 85022359 | 6/1985 |

OTHER PUBLICATIONS

"Dressing for Sucess: Preparing Grinding Wheels to be at Their Cutting Best", Debbie Simpson, Saint-Gobain Abrasives.*
"Grinding Technology Glossary".*
"Unlock secrets to truing, dressing abrasives" William D. James, Tooling and Products.*
European Serach Report, dated Oct. 19, 2005 issued for European patent application counterpart of above application.

* cited by examiner

*Primary Examiner*—M. Rachuba

(57) ABSTRACT

A cylindrical valve guide having a roughened external surface texture from about 50 to about 100 microinches permits effective amounts of lubricating oil to become trapped or contained by such roughened external surface and thereby facilitates subsequent press fitting of the valve guide into an internal combustion engine. Centerless grinding constitutes a preferred method of achieving the surface texture of the invention.

2 Claims, No Drawings

METHOD OF MAKING VALVE GUIDE HAVING TEXTURED EXTERNAL SURFACE

FIELD OF INVENTION

This invention relates to valve guides having a roughened external surface texture that facilitates press fitting (sometimes referred to as interference fitting) into internal combustion engine heads and a method of making such valve guides. The roughened surface serves to contain light lubricating oil that facilitates press fitting and avoids seizing or galling of the valve guide when inserted into the engine head. The valve guides are manufactured by grinding the surface of the valve guide, preferably with use of centerless grinding apparatus, to obtain the desired surface texture.

BACKGROUND OF THE INVENTION

Press fitting of slightly larger diameter valve guides into smaller diameter cylindrical counterbores contained in internal combustion engine heads is required to form a very stable fit between the two components, so that loosening is prevented and heat transfer is facilitated during operation of the engine. In the past, various surface textures and techniques have been used to facilitate press fitting of valve guides into internal combustion engine heads. For example, industrial specifications have required external surface textures for guide valves of 32 microinches maximum and 64 microinches maximum, respectively. No minimum surface texture is set forth in either specification. Valve guides having such above described surface textures are subsequently coated with an oil-containing coating that includes a lubricating oil so that press fitting of the valve guide into the engine head proceeds without seizing and/or galling. Phosphate coatings are typically used for this purpose. The present invention utilizes a roughened surface coating on the external surface of the valve guide that is capable of containing a sufficient amount of light lubricating oil to avoid the need for such oil-containing coatings.

Another industrial specification for valve guides requires an external surface texture of from 40 to 100 microinches. Valve guides manufactured under such specification are intended to be coated with a lubricating oil and then press fit into an engine head. It has been discovered by the present invention that such specification should be tightened to require external valve guide surfaces having a roughened surface from about 50 to about 100 microinches because the use of surface textures below about 50 microinches does not permit sufficient amounts of lubricating oil to be contained by the external surface to ensure that press fitting will proceed smoothly.

By way of further background, U.S. Pat. Nos. 4,896,638; 3,384,515; 3,828,415; 3,258,838; and 4,342,293 illustrate various manufacturing techniques for fabricating various engine components. U.S. Pat. No. 5,190,002 illustrates the use of certain surface textures for an engine valve that is sufficiently smooth to cause minimal wear during contact with other engine parts but also sufficiently rough to contain lubricating oils.

SUMMARY OF THE INVENTION

The present invention relates to a method of making cylindrical valve guides. The method comprises providing a cylindrical semi-finished valve guide having a longitudinal hollow interior and a longitudinal cylindrical external surface. The external surface is ground with a grinding wheel having a dressed grinding surface to obtain a roughened surface texture of from about 50 to 100 microinches. The product of such method is adapted to contain lubricating oil. Containing such lubricating oil facilitates press fitting into internal combustion engine heads.

DETAILED DESCRIPTION OF THE INVENTION

Valve guides are typically hollow metallic cylinders that are installed in internal combustion engine heads as axial bearings for valve stems. The guides serve to hold the valve face coaxial to the head or block seat and also serve as a heat sink to cool the valves. The most common installation procedure is to secure the valve guide through a press fit between the valve guide and the mating counterbore.

Valve guides are made from ferrous metals, such as pearlitic cast iron, and non-ferrous metals, such as bronze. Guides are manufactured using cast, wrought, or pressed and sintered powder metal processes. All of such metals, as well as other metals and composites, are within the scope of the present invention.

It has been discovered that cylindrical valve guides having a hollow longitudinal interior; a roughened cylindrical external surface having a texture from about 50 to about 100 microinches (as measured by a profilometer); and in an uncoated surface condition, except for a lubricating oil; are especially suited or adapted to be press fitted into internal combustion engine heads. Such degree of roughness is necessary to cause an effective amount of lubricating oil, such as a light lubricating oil, to be contained by the external surface and thus provide adequate lubrication during the press fitting operation. The about 50-microinch minimum ensures that the peaks and valleys associated with such minimum are sufficiently spaced apart to contain lubricating oil following distortion of the peaks during press fitting. The about 100-microinch maximum also ensures that the peaks and valleys are sufficiently spaced apart to contain lubricating oil during distortion of the peaks during press fitting. An insufficient amount of lubricating oil is contained when peaks and valleys associated with roughness levels below about 50 microinches are used. Peaks and valleys associated with roughness levels above about 100 microinches also contain insufficient amounts of lubricating oil because the spacing between the peaks and valleys is too large to adequately contain the oil.

A preferred surface texture ranges from about 65 to about 85 microinches because such tightened range further ensures that the valve guide surface will be able to contain an effective amount of lubricating oil during the press fitting operation.

The valve guides of the invention are generally produced by grinding the longitudinal, external surface of a cylindrical, semi-finished valve guide having a longitudinal hollow interior. Such grinding achieves a roughened external surface texture of from about 50 to about 100 microinches. Grinding may be performed with use of any suitable grinding apparatus and technique. Utilizing a centerless grinding apparatus and technique to produce centerless ground surface textures from about 50 to about 100 microinches is preferred because such type of grinding results in excellent precision and reproducibility. Such qualities are necessary to achieve the relatively tight surface texture tolerance of the invention.

Grinding is performed with use of a grinding wheel having a dressed grinding surface. A typical grinding wheel suitable for use in the invention is a silicon carbide crystallon type wheel having a wheel grit of 37 and a wheel hardness of K5V.

Dressing of the grinding wheel surface may be performed with a conventional dressing fixture that first contacts and then passes across the grinding surface to roughen such surface. A rotary star dresser fixture is suitable for use in the invention. A dresser graduation on the order of 0.001 inches is also suitable.

As mentioned above, dressing of the grinding surface may be performed by contacting such surface with a dressing fixture and then passing the fixture across the grinding surface to obtain the desired surface roughness. Multiple dressing passes to remove a total depth of from about 0.010 to about 0.020 inches from the grinding wheel constitute a typical dressing operation depth removal. A preferred dressing procedure comprises utilizing four dressing passes to remove a total grinding wheel depth of from about 0.012 to about 0.016 inches. Such procedure involves removal of from about 0.003 to about 0.004 inches per pass.

The method of the invention is illustrated in further detail by reference to the following Example:

EXAMPLE

A semi-finished cast iron valve guide 0.5 inches in diameter and 3.0 inches in length is ground by a centerless grinder having a grinding wheel with a dressed grinding surface.

Dressing of the grinding wheel surface is accomplished by contacting the surface with a rotary star dresser fixture and then passing such fixture across the surface of a rotating silicon carbide crystallon wheel. Four dressing passes are made with each pass resulting in a depth removal of from 0.003 to 0.004 inches and resulting in a total depth removal of 0.014 inches.

The thus dressed grinding wheel is then used to grind the external surface of the semi-finished valve guide and thereby obtains a roughened surface texture of 75 microinches.

A light lubricating oil is applied to the textured surface and a sufficient amount of such oil is contained by the surface to facilitate press fitting of the valve guide into an engine head. The valve guide is then press fitted into a counterbore in an engine head without seizing or galling during the fitting process.

It is claimed:

1. A method of making a valve guide for use in an internal combustion engine comprising, (a) Providing a cylindrical semi-finished valve guide having a longitudinal hollow interior and a longitudinal cylindrical external surface; and (b) Centerless grinding said external surface with a grinding wheel having a dressed grinding surface to obtain a roughened surface texture on said external surface of from about 50 to about 100 microinches, wherein said grinding surface of said grinding wheel is dressed through contacting the grinding surface with a dressing fixture and then making at least four passes of said dressing fixture across said grinding surface during rotation of said grinding wheel with about 0.003 to about 0.004 inches in depth being removed from said grinding surface during each pass to remove a total depth of about 0.010 to about 0.020 inches from said grinding surface.

2. The method of claim 1, wherein said dressing fixture comprises a rotary star dresser.

* * * * *